US008220452B2

(12) United States Patent
Brown

(10) Patent No.: US 8,220,452 B2
(45) Date of Patent: Jul. 17, 2012

(54) REMOVABLE FIREPLACE CLEANOUT

(76) Inventor: John P. Brown, Fort Worth, TX (US)

( * ) Notice: Subject to any disclaimer, the term of this patent is extended or adjusted under 35 U.S.C. 154(b) by 1881 days.

(21) Appl. No.: 10/940,994

(22) Filed: Sep. 15, 2004

(65) Prior Publication Data

US 2006/0054161 A1 Mar. 16, 2006

(51) Int. Cl.
*F23H 11/24* (2006.01)
*F23J 1/02* (2006.01)
*F27D 15/00* (2006.01)

(52) U.S. Cl. ..... 126/555; 126/242; 126/243; 126/532; 126/554; 110/166; 110/167; 110/259; 220/535; 220/911; 221/288

(58) Field of Classification Search ..... 126/242–245, 126/555, 554, 280, 283, 532; 110/166, 167, 110/259; 220/911, 535; 221/288
See application file for complete search history.

(56) References Cited

U.S. PATENT DOCUMENTS

| | | | | |
|---|---|---|---|---|
| 288 | A | 7/1837 | Conger | |
| 1,155,875 | A | 10/1915 | Blass | |
| 1,472,659 | A * | 10/1923 | Mayer | 110/167 |
| 1,477,930 | A | 12/1923 | Bartholomew et al. | |
| 2,408,921 | A * | 10/1946 | Esson | 126/245 |
| 2,482,068 | A * | 9/1949 | Larson | 126/25 R |
| 2,506,643 | A * | 5/1950 | Jaye | 110/175 R |
| 3,663,982 | A | 5/1972 | Hayden | |
| 4,307,704 | A * | 12/1981 | Wagg | 126/245 |
| 4,706,648 | A | 11/1987 | Blount et al. | |
| 5,010,874 | A * | 4/1991 | Toth | 126/543 |
| 5,513,625 | A * | 5/1996 | Landman | 126/152 R |
| 5,542,346 | A | 8/1996 | Shenk | |
| 5,694,918 | A | 12/1997 | Blount | |
| 6,006,744 | A | 12/1999 | Taylor | |
| 6,669,214 | B1 | 12/2003 | Domis | |

FOREIGN PATENT DOCUMENTS

| | | |
|---|---|---|
| GB | 992340 | 5/1965 |
| GB | 2142138 | 1/1985 |

OTHER PUBLICATIONS

"Adjacent" Encarta World Dictionary, North American Ed. 2003. <http://encarta.msn.com/encnet/features/dictionary/DictionaryResults.aspx?refid=1861583686>.*

* cited by examiner

*Primary Examiner* — Steven B McAllister
*Assistant Examiner* — Daniel E Namay
(74) *Attorney, Agent, or Firm* — Richard C. Litman

(57) ABSTRACT

The removable fireplace cleanout facilitates the chore of cleaning ash and/or other residue from a fireplace. The cleanout device is a relatively wide, low pan or tray configured for placement within a fireplace hearth. Wheels and/or other rolling supports extend beneath the device to facilitate its installation in and removal from the fireplace hearth. One wall of the device includes a dump door, with the weighted door being held closed by gravity until the unit is tilted to dump ash and residue therein. Fillets may be provided to preclude trapping of ash in the corners of the device. An integral grate may be permanently installed atop the floor of the device, thereby precluding need for grate removal and soiling of the area where the grate is placed during conventional fireplace cleanout.

10 Claims, 5 Drawing Sheets

REMOVABLE FIREPLACE CLEANOUT

BACKGROUND OF THE INVENTION

1. Field of the Invention

The present invention relates generally to fireplace accessories, and more specifically to a removable fireplace cleanout that is a portable device for installation within a fireplace to collect ashes and debris.

2. Description of the Related Art

The fireplace has a very traditional place in the American home, with many people enjoying the figurative, if not the literal, warmth provided by such an appliance. While fireplaces are not commonly used to provide warmth or for other utilitarian purposes any more, they still nonetheless provide a cheery and cozy atmosphere when in use.

However, the burning of solid fuel in a fireplace, whether wood, paper logs, coal, or other solid material, invariably leaves a residue of ashes and/or other debris. While fireplaces are enjoyable parts of many homes, they are nonetheless relatively messy and time consuming to maintain, particularly when it comes to maintaining cleanliness.

As a result, a number of devices have been developed to facilitate fireplace cleanup and/or to reduce the spread of ashes or other debris. However, even when a tray is provided that fits into the fireplace opening beneath the grate for collecting ashes and other debris, it is difficult to manipulate the tray to dispose of the ashes and debris without creating a mess in the process, both during removal of the grate and while dumping the ashes from the tray. Thus, a removable fireplace cleanout solving the aforementioned problems is desired.

SUMMARY OF THE INVENTION

The removable fireplace cleanout device is a relatively low and wide tray which is placed within the fireplace to collect ash and/or other residue resulting from the burning process. The tray is trapezoidal or rectangular, being supported on a pair of spaced apart rear wheels and a fixed, central front leg. Handles extend from the front and sidewalls, respectively. The rear wall includes a top hinged, automatic cleanout door in one sidewall thereof. The device is removed from the fireplace by lifting the front leg and rolling the tray out of the fireplace. Tilting the device towards the door in the rear wall causes the door to open due to gravity, allowing collected ash and residue to pour from the door. Fillets may be provided within the ash collection tray to guide the residue toward the door and preclude trapping of such residue in the corners of the device.

The grate may be removably placed on the bottom floor of the tray to allow use of any desired grate and to facilitate dumping ashes from the tray by those unable to lift the combined weight of a grate and tray or who find it awkward to do so. Alternatively, the grate may be permanently affixed thereto. When the grate is permanently affixed to the floor of the tray, any mess attendant to removal of the grate from the tray prior to dumping the ashes and debris is avoided. The device may be formed in a wide number of different configurations other than rectangular or trapezoidal to fit various shapes and sizes of fireplaces.

These and other features of the present invention will become readily apparent upon consideration of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
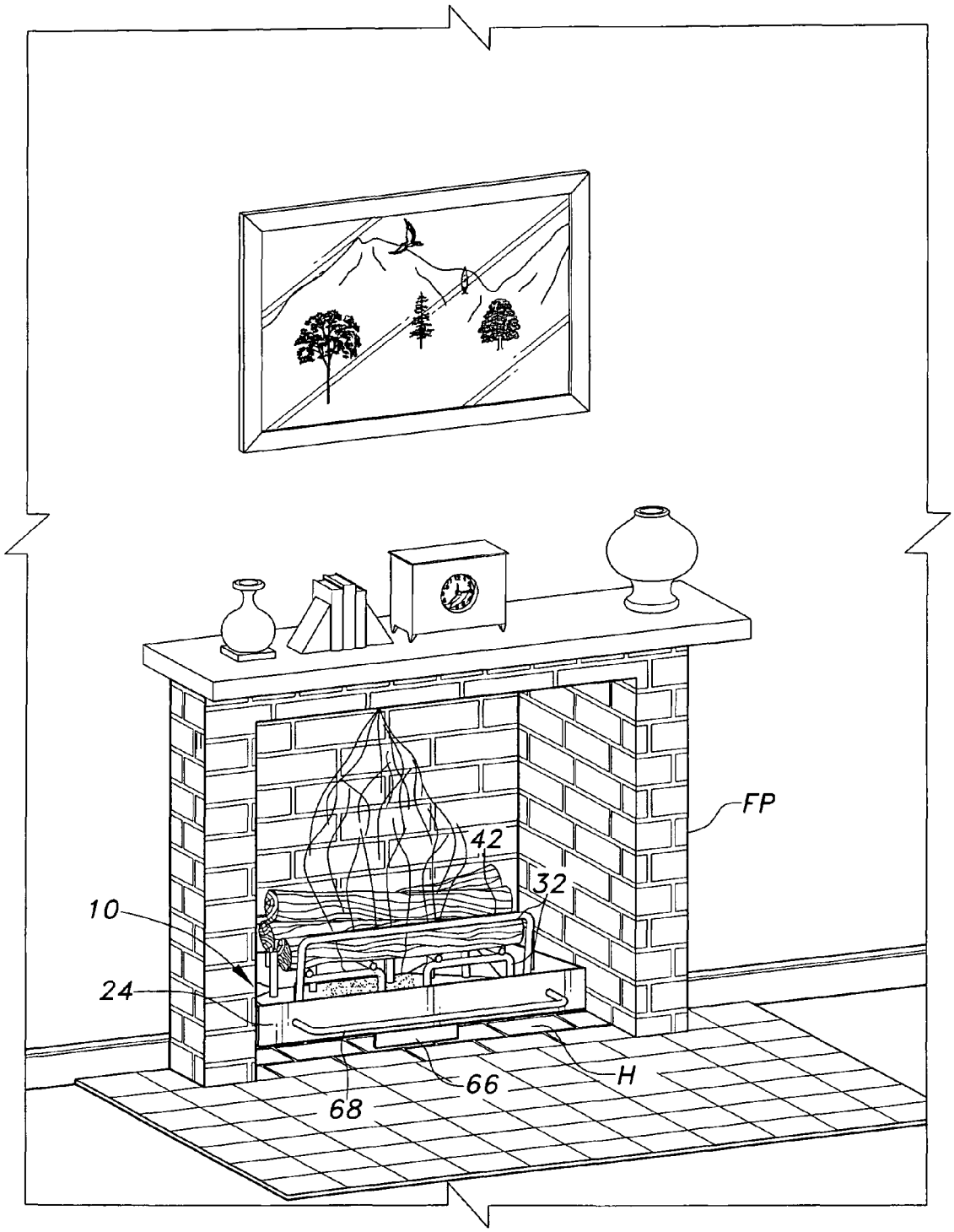
FIG. 1 is an environmental, perspective view of a removable fireplace cleanout according to the present invention, showing its placement and use within a fireplace.

The present invention comprises various embodiments of a fireplace cleanout device which is removably placed within the hearth H of a fireplace FP to facilitate the cleaning of the fireplace FP of ash and/or other residue after use. FIG. 1 provides an illustration of the general nature and environment of the present fireplace cleanout, with FIGS. 2, 3, and 4 illustrating its use and FIG. 5 providing a top plan view to show various configurations and details of the device.

Figure 4:
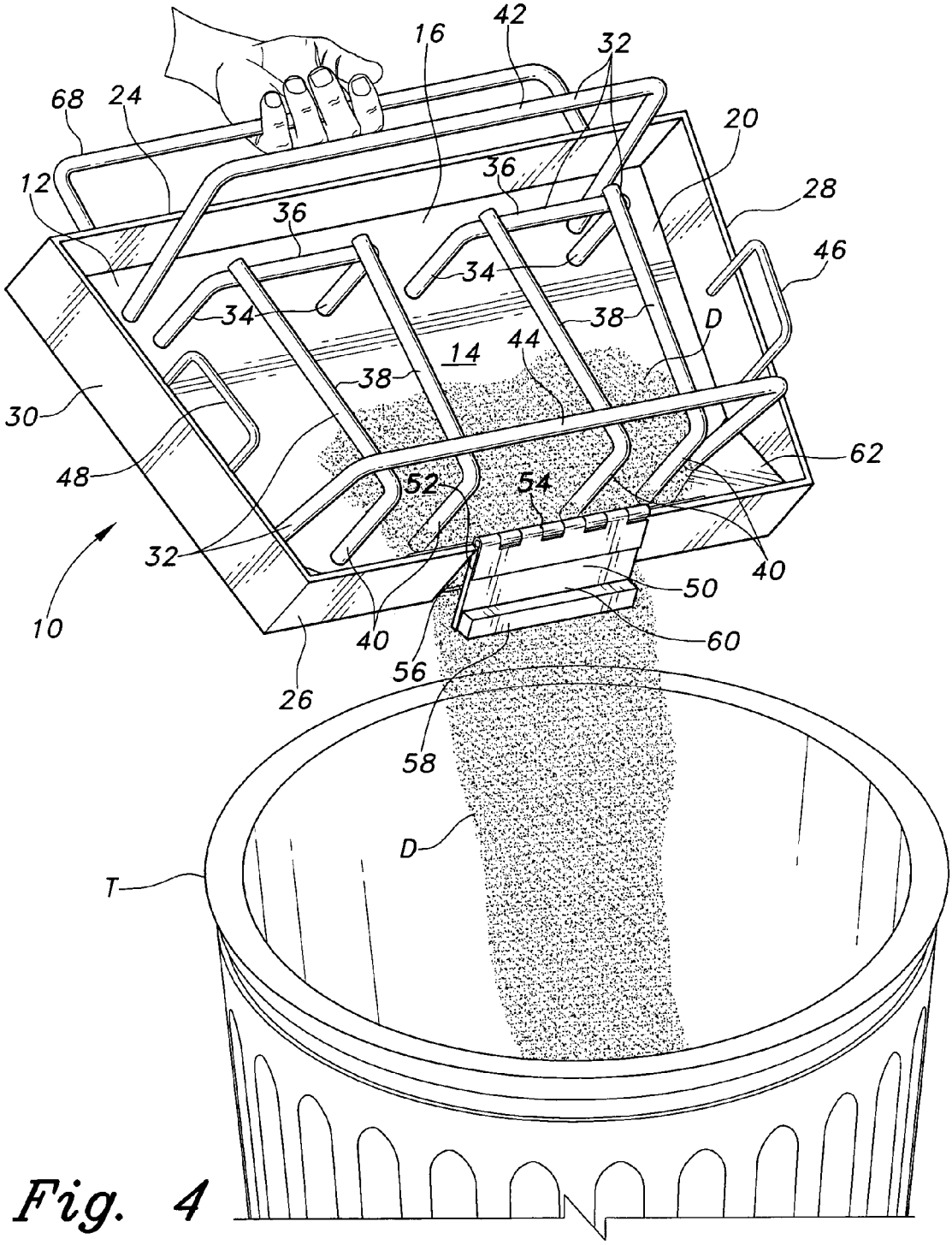
FIG. 4 is a perspective view of another embodiment of the fireplace cleanout device with a grate affixed thereto, showing the operation of the weighted automatic dump door during ash dumping.
Figure 5:
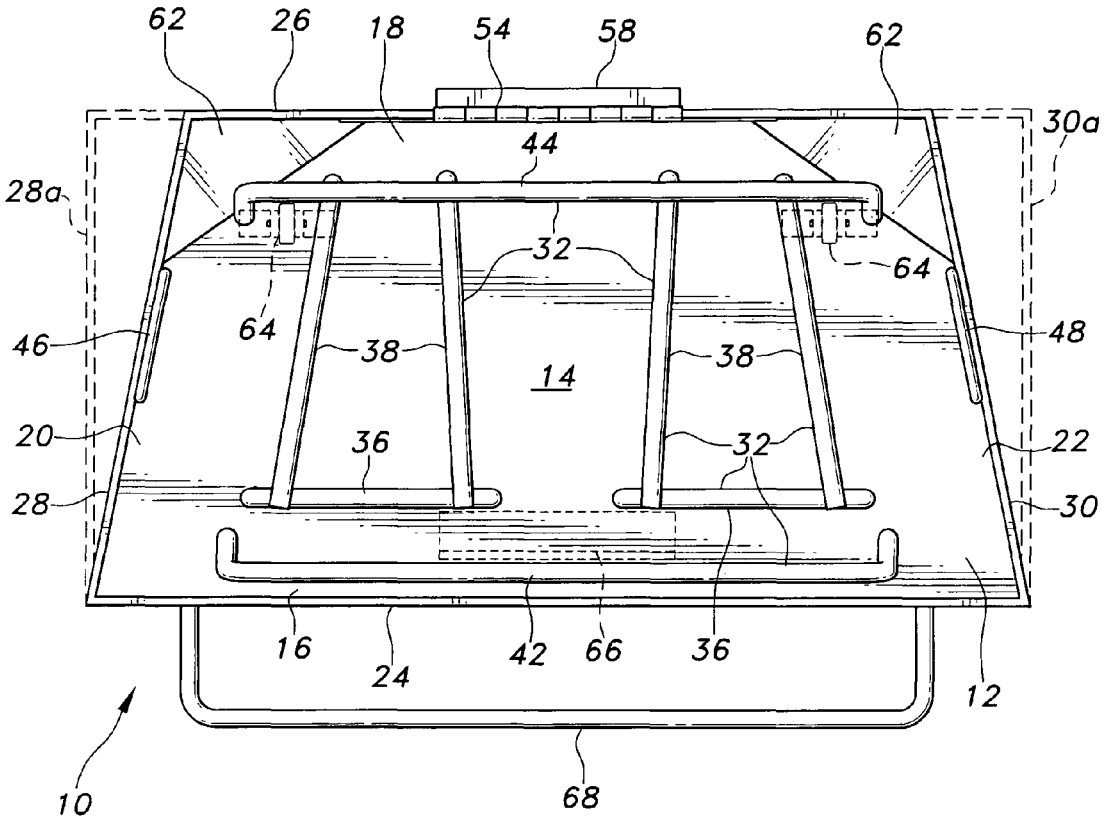
FIG. 5 is a top plan view of the fireplace cleanout device, showing various alternative configurations therefor.

The removable fireplace cleanout 10 generally comprises a debris collection tray 12 formed of a floor pan 14 having a front edge portion 16, opposite rear edge portion 18, and opposed first and second lateral edge portions 20 and 22, as shown in FIG. 5. Each edge portion 16 through 22 has a relatively low wall extending upwardly therefrom, including a front wall 24, an opposite rear wall 26, and first and second lateral walls 28 and 30, as shown in FIGS. 3 and 4 of the drawings. The above-described structure comprising components 12 through 30 may be formed of a relatively heavy gauge of sheet metal, e.g. sixteen-gauge steel or other suitable material. The various walls 24 through 30 may be welded to the corresponding edge portions 16 through 22 of the floor pan 14 and to one another at their mutual ends, with such welds preferably forming unbroken and leakproof seams to preclude leakage of ashes and/or other debris therefrom.

Figure 2:
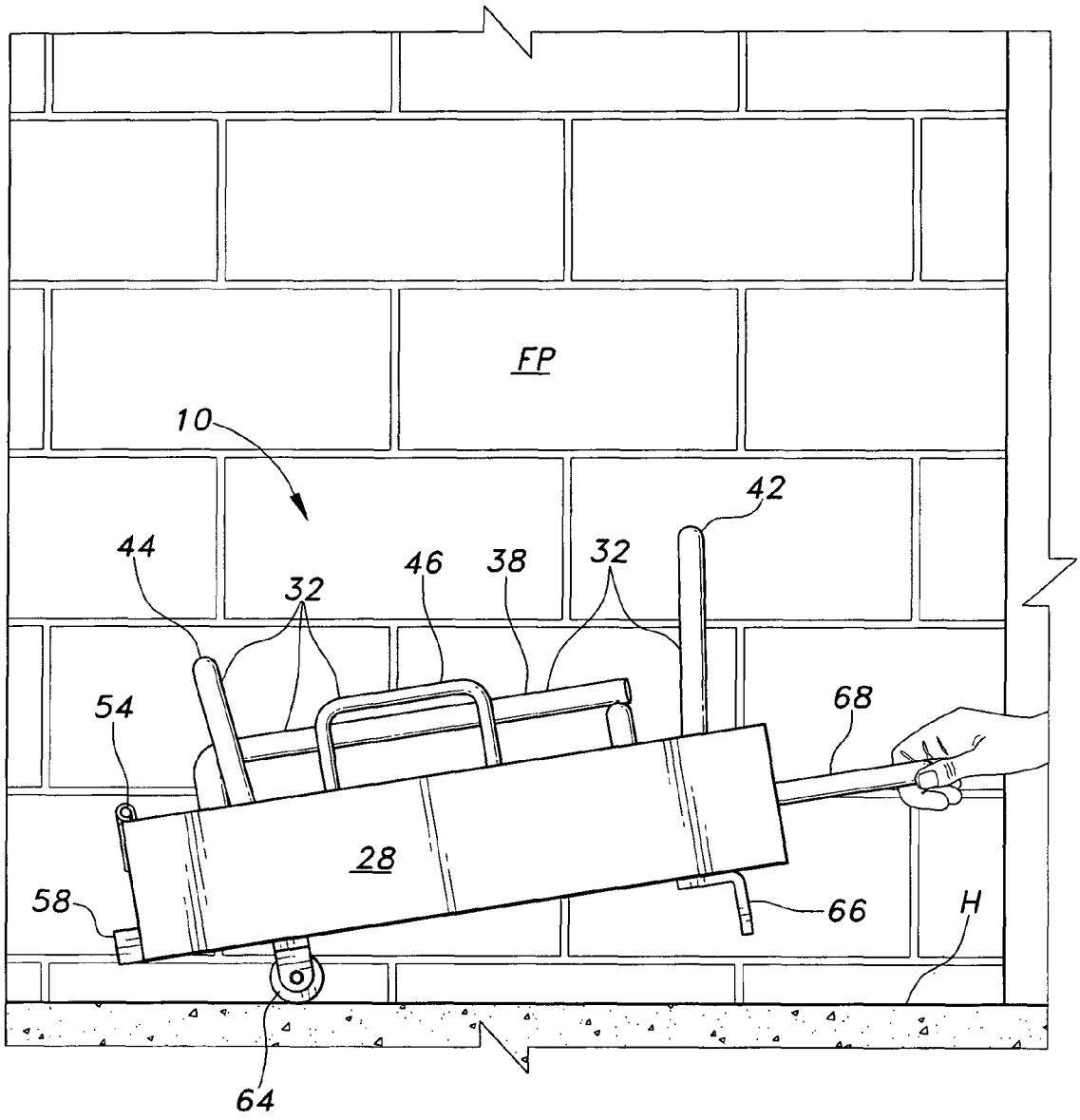
FIG. 2 is a side elevation view of the fireplace cleanout device, showing the removal or installation procedure in a fireplace.

Referring to FIG. 2, the tray 12 is supported on a pair of spaced apart wheels 64 disposed towards the rear of the tray 12 and an elongated stationary leg 66, e.g., an angle iron welded to the bottom of the floor pan 14, extending centrally across the front end of the tray 12, providing a generally triangular support. A single elongated roller may be used in place of wheels 64. A front handle 68 extends laterally from the front wall 24 of the tray 12. Side handles 46 and 48 extend upward from the sidewalls 28 and 30 of the tray 12, as seen more clearly in FIG. 5.

Figure 3:
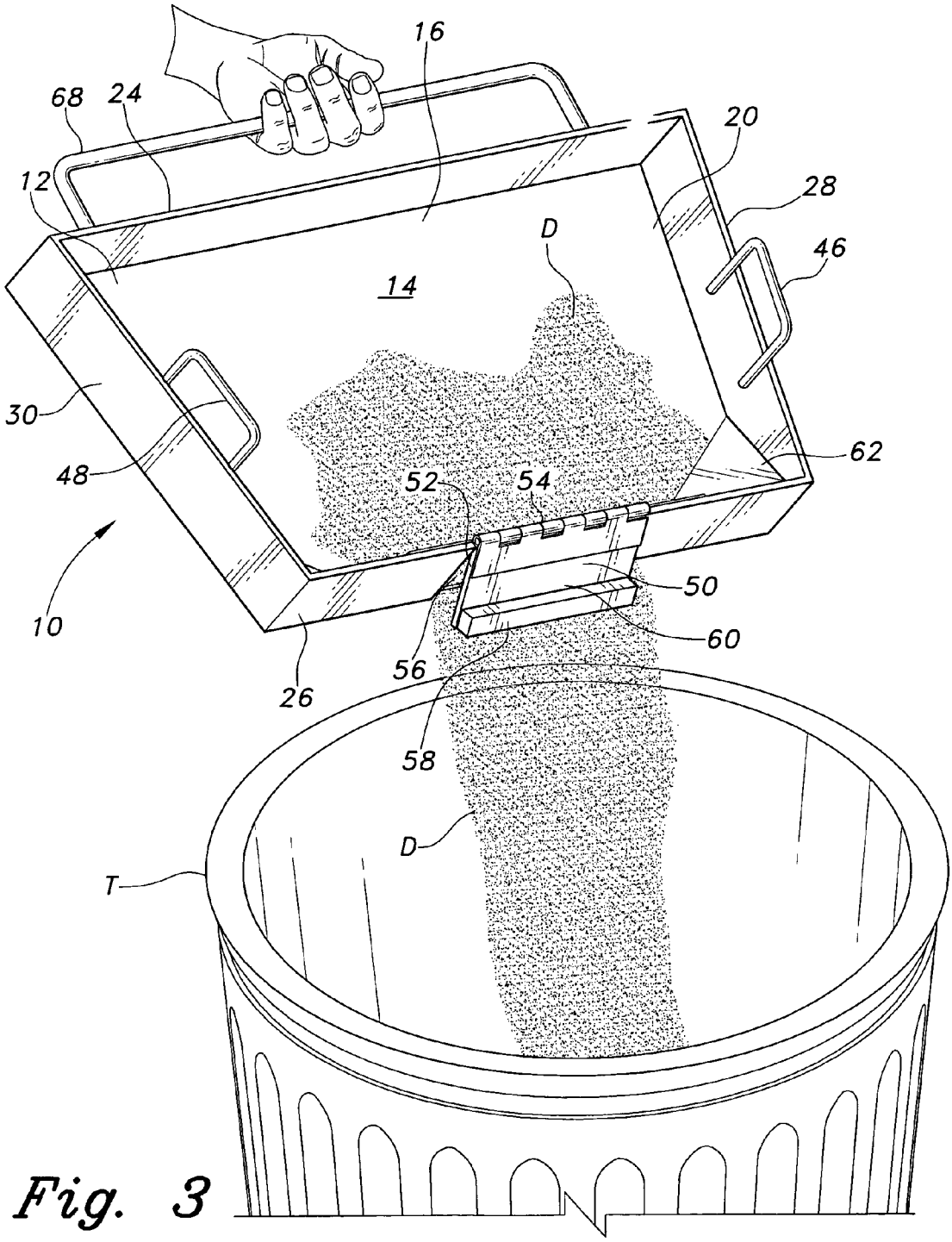
FIG. 3 is a perspective view of an embodiment of the fireplace cleanout device without a grate affixed thereto, showing the operation of the weighted automatic dump door during ash dumping.

A debris dump door 50 is also provided with the present fireplace cleanout 10, the door 50 being most clearly shown in FIGS. 3 and 4. The door 50 is installed in the rear wall 26 of the device, and is formed by a panel having with its upper edge 52 secured to at least one hinge 54, e.g., a piano hinge (although more than one hinge may be provided, if desired) installed across the upper edge of the rear wall 26. The door 50 thus swings downwardly to a normally closed position when the device 10 is resting with its floor pan 14 in a horizontal position. The door 50 will remain closed as long as the device 10 is horizontal, or as long as the rear wall 26 is raised above the front wall 24. However, when the fireplace cleanout 10 is tilted to lower its rear wall 26, the door 50 swings open due to gravity to allow any ash and/or other residue and debris D to pour from the opening 56 in the rear wall 26, generally as shown in FIGS. 3 and 4.

A heavy weight 58, e.g., a steel bar, etc., may be welded or otherwise secured to the lower portion 60 of the door 50 to assist in holding the door 50 closed when the device is horizontal and in opening the door 50 when the front portion of the device 10 is raised. The door 50 and its opening 56 may be somewhat narrower than the span of the rear wall 26, in order to avoid spillage of debris D around the edges of a trash container C or the like. Corner fillets 62, most clearly shown in FIG. 5, may be installed in the corners of the debris collection tray 12 to each side of and adjacent to the door 50, to guide the ash and debris D contained within the device 10 to the door opening 56 and preclude the trapping of such debris D within the corners of the tray 12. Also, when the shape of the tray 12 is trapezoidal, the lateral sidewalls 28 and 30 assist, to some extent, in funneling the ashes and debris towards the dump door 50.

Thus, a user of the present fireplace cleanout device 10 need only lift the forward portion of the device 10 and pull it from the fireplace FP by means of the forwardly disposed handle 68 to remove it from the fireplace FP, with at least one-half of the weight of the device 10 being supported by the rearwardly disposed wheels 64. As the present cleanout device captures substantially all of the ash and debris therein when burning solid fuel, the floor of the hearth H remains relatively clean, thus allowing the wheels 64 to roll over a smooth surface with little resistance. This also permits the device 10 to be withdrawn from the fireplace FP for stocking with fuel (wood splits or logs, newspaper logs, etc.) to preclude need for leaning into the fireplace FP to stock the device 10. The emptied or freshly restocked fireplace cleanout device 10 may then be easily rolled back into the fireplace FP, generally as shown in FIG. 4. Alternative support means may be provided as desired, e.g. solely wheels, solely support legs or skids, etc., as desired. Ashes may be dumped from the tray 12 by removing the grate and lifting the tray 12 with side handles 46 and 48, or alternatively by front handle 68, and then tilting the tray 12 by raising the front wall 24 to funnel the ashes toward dump door 50, which opens by gravity.

FIG. 5 provides a top plan view of a pair of different embodiments of the present fireplace cleanout device 10. Fireplaces may have many different configurations, with many of them having a trapezoidal floor plan with a relatively wide hearth opening and a narrower back portion. Accordingly, the present fireplace cleanout device 10 may be configured to have a similar planform in order to avoid substantial spillage of ash or debris around the edges of the device, generally as shown by the embodiment shown in solid lines in FIG. 5. However, it will be recognized that the present device 10 may be configured in other ways, e.g. to have a rectangular planform, as shown by the alternative parallel first and second lateral walls 28*a* and 30*a* in FIG. 5. Other configurations may be provided in addition to those illustrated.

Instead of a removable grate, the removable fireplace cleanout 10 may include a permanently installed and immovably affixed grate structure 32 extending upwardly from the floor pan 14. The grate assembly 32 may be an integral structural component of the present device 10, and may be welded or otherwise permanently attached to the underlying floor pan 14 to preclude its removal therefrom, generally as shown in FIG. 4 of the drawings.

Any appropriate grate assembly may be affixed to the floor 14. In the embodiment shown, the grate assembly 32 comprises a series of vertical components 34 (shown most clearly in FIG. 4) having horizontal elements 36 for the support of further horizontal bars 38, with the bars 38 having additional vertical support legs 40 (shown in FIG. 4) generally opposite the vertical components 34. Forward and rearward laterally extending members, respectively 42 and 44, elevated above centrally disposed horizontal support bars 38, may also be permanently and integrally affixed immovably to the structure to maintain logs or other solid fuel centered on the bars 38 from front to rear. Other grate configurations may be provided as desired, so long as the grate assembly provides for the support of relatively large pieces of solid fuel spaced above the underlying floor pan 14, to allow air circulation around the fuel and efficient burning of the fuel.

It is to be understood that the present invention is not limited to the embodiments described above, but encompasses any and all embodiments within the scope of the following claims.

I claim:

1. A removable fireplace cleanout, comprising:

a debris collection tray having a floor pan defining a periphery and a plurality of sidewalls extending upward from the periphery, including a front wall, a rear wall, and first and second lateral sidewalls, the rear wall having an opening defined therein;

a debris dump door panel having an upper edge and a lower edge;

a weight mounted adjacent the lower edge of said debris dump door panel; and at least one top-mounted hinge pivotally attaching the upper edge of the dump door to the rear wall of the tray, whereby the dump door closes the opening in the rear wall when the tray is level and swings open by gravity when the tray is tilted so that the rear wall is downward.

2. The removable fireplace cleanout according to claim 1, further including corner fillets disposed within said debris collection tray, to each side of and adjacent said dump door.

3. The removable fireplace cleanout according to claim 1, further including a grate permanently affixed to the floor pan of said tray.

4. The removable fireplace cleanout according to claim 1, further including at least one rolling support depending from said floor pan adjacent said rear wall and at least one stationary support leg depending from said floor plan adjacent said front wall, the rolling support and the stationary support leg being substantially equal in height in order to maintain said floor pan level when said tray rests on a horizontal surface.

5. The removable fireplace cleanout according to claim 1, wherein said tray is trapezoidal, whereby ashes and debris are funneled toward said dump door when said tray is tilted.

6. The removable fireplace cleanout according to claim 1, further including a front handle extending laterally outward from the front wall and a pair of side handles extending upward from the sidewalls of said tray.

7. A removable fireplace cleanout, comprising:

a debris collection tray having a floor pan defining a periphery and a plurality of sidewalls extending upward from the periphery, including a front wall, a rear wall, and first and second lateral sidewalls, said rear wall having an opening formed therethrough;

a debris dump door panel having an upper edge and a lower edge;

a weight mounted adjacent the lower edge of said debris dump door panel;

pivotal means pivotally joining the upper edge of said debris dump door to the rear wall of said debris collection tray, whereby the dump door selectively closes the opening in the rear wall when the tray is level and swings open by gravity when the tray is tilted so that the rear wall is downward; and, a grate permanently affixed to the floor pan of said tray.

8. The removable fireplace cleanout according to claim 7, further including corner fillets disposed within said debris collection tray, to each side of and adjacent said dump door.

9. The removable fireplace cleanout according to claim 7, further including at least one rolling support depending from said floor pan adjacent said rear wall and at least one stationary support leg depending from said floor plan adjacent said front wall, the rolling support and the stationary support leg being substantially equal in height in order to maintain said floor pan level when said tray rests on a horizontal surface.

10. The removable fireplace cleanout according to claim 7, further including at least one handle extending upward from each of the lateral sidewalls of said tray.

* * * * *